US009580282B2

(12) United States Patent
Leinonen et al.

(10) Patent No.: US 9,580,282 B2
(45) Date of Patent: Feb. 28, 2017

(54) CRANE

(71) Applicant: Ponsse Oyj, Vierema (FI)

(72) Inventors: Yrjö Leinonen, Koljonvirta (FI); Marko Halonen, Iisalmi (FI); Toni Auvinen, Laukkala (FI)

(73) Assignee: Ponsse Oyj (FI)

( * ) Notice: Subject to any disclaimer, the term of this patent is extended or adjusted under 35 U.S.C. 154(b) by 0 days.

(21) Appl. No.: 14/648,364

(22) PCT Filed: Dec. 2, 2013

(86) PCT No.: PCT/FI2013/051126
§ 371 (c)(1),
(2) Date: May 29, 2015

(87) PCT Pub. No.: WO2014/087049
PCT Pub. Date: Jun. 12, 2014

(65) Prior Publication Data

US 2015/0298944 A1 Oct. 22, 2015

(30) Foreign Application Priority Data

Dec. 3, 2012 (FI) ..... 20126260

(51) Int. Cl.
*E04G 3/00* (2006.01)
*B66C 23/00* (2006.01)
(Continued)

(52) U.S. Cl.
CPC ..... *B66C 23/54* (2013.01); *B66C 23/42* (2013.01); *F15B 9/02* (2013.01); *E02F 9/2217* (2013.01);
(Continued)

(58) Field of Classification Search
CPC ..... B66C 23/24; B66C 23/54; B66C 23/42; E02F 9/2217
See application file for complete search history.

(56) References Cited

U.S. PATENT DOCUMENTS 4,643,358 A * 2/1987 Jackson ..... A01M 7/0075 172/456
6,193,087 B1 * 2/2001 Gunnarsson ..... B66C 23/54 212/232
(Continued)

FOREIGN PATENT DOCUMENTS

WO 2011132673 10/2011

OTHER PUBLICATIONS

International Search Report, dated Mar. 20, 2014, issued in International Application No. PCT/FI2013/051126 (3 pages.).

*Primary Examiner* — Amy Sterling
(74) *Attorney, Agent, or Firm* — Beem Patent Law Firm

(57) ABSTRACT

The invention relates to a crane comprising
- a base for attaching the crane to a harvester or similar work machine,
- a main boom having two ends, one end pivoted to the base,
- an articulated boom having two ends, one end pivoted to the said main boom ,
- an actuator cylinder for moving the main boom relative to the base having a cylinder part,
- a second actuator cylinder for moving the articulated boom relative to the main boom,
- a pressure cylinder in connection with one actuator cylinder, arranged to follow this actuator cylinder in order to produce pressure for the second actuator cylinder, (Continued)

wherein the pressure cylinder is arranged to form an essentially coaxial multi-chamber cylinder with the actuator cylinder to be followed.

21 Claims, 9 Drawing Sheets

(51) Int. Cl.

| | |
|---|---|
| ***B66C 23/42*** | (2006.01) |
| ***F15B 9/02*** | (2006.01) |
| *E02F 9/22* | (2006.01) |
| *F15B 11/036* | (2006.01) |

(52) U.S. Cl.
CPC ..... *E02F 9/2225* (2013.01); *E02F 9/2271* (2013.01); *F15B 11/036* (2013.01); *F15B 11/0365* (2013.01)

(56) References Cited

U.S. PATENT DOCUMENTS

| | | | | |
|---|---|---|---|---|
| 6,267,387 | B1 * | 7/2001 | Weiss | B60G 3/26 280/124.106 |
| 7,523,834 | B2 * | 4/2009 | Leinonen | B66C 23/54 212/238 |
| 7,581,486 | B2 | 9/2009 | Grieser | |
| 9,021,798 | B2 * | 5/2015 | Sipola | F15B 11/036 60/428 |
| 2013/0000288 | A1 * | 1/2013 | Ho | E02F 9/2214 60/327 |
| 2013/0098464 | A1 * | 4/2013 | Knussman | E02F 9/2235 137/12 |

* cited by examiner

CRANE

This application claims benefit of priority from International Patent Application No: PCT/FI2013/051126filed Dec. 3, 2013, which claims benefit of Finland Patent Application No. 20126260, both of which are incorporated by reference in their entirety.

FIELD OF THE INVENTION

The present invention relates to a crane, which includes a base for attaching the crane, a main boom pivoted to the base, an articulated boom pivoted to the main boom, an actuator cylinder for moving the main boom relative to the base, a second actuator cylinder for moving the articulated boom relative to the main boom, and a pressure cylinder in connection with one actuator cylinder, arranged to follow this actuator cylinder in order to produce pressure for the second actuator cylinder.

BACKGROUND OF THE INVENTION

In known harvesters, two crane types, with a different main principle, are generally used, which are a path-of-motion crane and a sliding-boom crane. In harvesters, path-of-motion cranes are the most generally used and are manufactured in several different implementations by several different manufacturers. The basic idea of a path-of-motion crane is to implement an essentially horizontal, approximately linear movement of the outer end of the crane's boom, and simultaneously the load being carried by it, by guiding a single operating device, for example a hydraulic cylinder. This property is regarded as being advantageous and desirable in harvester machines, the task of the boom of which is mainly to use the boom to lift trees from around the machine for processing in the harvester head.

U.S. Pat. No. 7,523,834 B2, which discloses one form of implementation for a path-of-motion crane, is known from the prior art. The path-of-motion crane consists of a base, to which is pivoted a main boom, an articulated boom being pivoted in turn to the main boom. Between the base and the main boom is a lifting cylinder for lifting the main boom and in connection with the main boom is an actuator cylinder for operating the articulated boom. The folding movement of the articulated boom is created with the aid of the actuator cylinder and an arm mechanism connected to it. Drawbacks with the solution are the additional weight brought by the arm mechanism, as well as the complexity of the design of the arm mechanism. In addition, the complicated arm mechanism, located far from the lifting boom, can obscure visibility from the operator.

According to a second solution according to the prior art, the lifting cylinder and the actuator cylinder are synchronized with the aid of a pressure cylinder, which replaces the arm mechanism. The piston rods of the pressure cylinder and the actuator cylinder are permanently connected to each other, so that, when the actuator cylinder moves, the pressure cylinder follows the movement of the actuator cylinder, producing pressure and volume flow for the lifting cylinder.

The pressure cylinder and the actuator cylinder are pivoted in parallel between the main boom and the articulated boom. The feed pressure is directed only to the actuator cylinder, which creates an uneven loading in the attachment of the actuator cylinder and the pressure cylinder. This uneven loading tends to twist the booms and the pivots, creating asymmetrical stresses in the structure of the path-of-motion crane. In order to ensure the working life of the structures, the booms and pivots must be reinforced and made sturdier than usual. In addition, the strokes of the parallel cylinders must be made very precisely the same length, otherwise the difference in the length of stroke will also create serious additional stresses in the structures.

SUMMARY OF THE INVENTION

The invention is intended to create a better crane than the cranes of the prior art, in which the stresses on the booms and pivots are aligned symmetrically and which can be manufactured more compactly. The crane according to one embodiment of the present invention is characterized by a crane, comprising a base for attaching the crane, a main boom pivoted to the said base, an articulated boom pivoted to the said main boom, an actuator cylinder for moving the said main boom relative to the base, a second actuator cylinder for moving the said articulated boom relative to the main boom, a pressure cylinder in connection with one actuator cylinder, arranged to follow this actuator cylinder in order to produce pressure for the second actuator cylinder, wherein the said pressure cylinder is arranged to form an essentially coaxial multi-chamber cylinder with the actuator cylinder to be followed.

This intention can be achieved by means of a crane, which includes a base for attaching the crane, a main boom pivoted to the base, and an articulated boom pivoted to the main boom. In addition, the crane includes at least two actuator cylinders for driving the main boom and the articulated boom, and a pressure cylinder arranged to follow one actuator cylinder in order to produce pressure for the other actuator cylinder. The pressure cylinder is arranged essentially coaxially with one actuator cylinder to form a multi-chamber cylinder. Thus, both the actuator cylinder and the pressure cylinder are located coaxially, so that the forces directed by the actuator cylinder and the pressure cylinder act on the attachments and the booms symmetrically. In addition, the structure can be implemented without an arm mechanism, thus achieving a structure that is lighter than the solutions of the prior art.

Preferably, the actuator cylinder operating the main boom is a lifting cylinder and the actuator cylinder operating the articulated boom is a articulation cylinder.

Preferably, the pressure cylinder is operationally between the actuator cylinders.

Preferably, the articulation cylinder is integrated with the pressure cylinder to form a multi-chamber cylinder, so that the lifting cylinder can be operated separately without moving the articulation cylinder. This permits lifting the end of the articulated boom of the crane to a selected height, without moving the articulation cylinder.

Preferably, the crane is a path-of-motion crane, in which the functions of the actuator cylinders are synchronized. This permits the operation of the crane using a single control.

According to one embodiment, in the multi-chamber cylinder the actuator cylinder and pressure cylinder are at least partly on top of/inside each other in the radial direction of the multi-chamber cylinder. Thus, the multi-chamber cylinder can be noticeably short in length and in general quite compact.

The multi-chamber cylinder can include a cylinder component and a hollow piston rod, which piston rod is hollow as far as the outer surface of the cylinder component of the multi-chamber cylinder. With the aid of the hollow piston rod, several cylinder chambers can be formed in the multi-chamber cylinder.

Preferably the multi-chamber cylinder includes four cylinder chambers, of which the first cylinder chamber on the side of the bottom belonging to the multi-chamber cylinder and the second cylinder chamber inside the piston rod on the piston rod side belonging to the multi-chamber cylinder are arranged to form the actuator cylinder. The third cylinder chamber outside the piston rod, on the side of the piston rod of the multi-chamber cylinder and the fourth cylinder chamber outside the cylinder component inside the piston rod are arranged to form the pressure cylinder. By means of such a construction, sufficient force is achieved to operate the actuator cylinder.

According to a second embodiment, in the multi-chamber cylinder the actuator cylinder and the pressure cylinder are essentially coaxially sequential. Such a multi-chamber cylinder structure is easy and cheap to manufacture and with the aid of the construction the manufacture of a hollow piston rod is avoided.

The multi-chamber cylinder can include a cylinder component, a partition for dividing the cylinder component into two parts, and a piston rod penetrating the partition. The piston rod can then be continuous and solid.

Preferably, in the multi-chamber cylinder the actuator cylinder is on the piston-rod side. A sufficiently large force is then obtained for retracting the multi-chamber cylinder.

Preferably, the multi-chamber cylinder has a smaller amount of play than the actuator cylinder which does not belong to the multi-chamber cylinder. In that case, if the articulation cylinder is the multi-chamber cylinder, play will remain in the lifting cylinder for adjusting the height of the end of the articulated boom, even though the lifting play of the articulation cylinder would be used entirely.

The crane can include a wide-angle pivot pivoted to the articulated boom, to which wide-angle pivot the actuator cylinder operating the articulated boom is pivoted directly. The crane can then be implemented without an arm mechanism, which makes the operation and design of the crane more difficult.

The actuator cylinder operating the main boom can be pivoted between the base and the main boom. The construction of the base can then be simple and it can be implemented without a lever arm.

According to one embodiment, the main boom includes two boom parts, which are connected to each other at an obtuse/reflex angle. Thus, the crane is given additional reach without increasing the stroke of the lifting cylinder.

Preferably, the main boom comprises a first end and a second end, through the first end of which the main boom is pivoted to the base and the articulated boom is pivoted at one end to the second end of the main boom. This maximises the reach of the crane.

The crane can include two pressure cylinders and both actuator cylinders can be multi-chamber cylinders. The pressure level of the hydraulic pump can then be kept lower in all operating situations.

The crane can include a hydraulic accumulator fitted in connection with the multi-chamber cylinder operating the main boom, in order to produce additional pressure for the multi-chamber cylinder. In the hydraulic accumulator there can be, for example, a charging pressure, which can be used in the multi-chamber cylinder to carry the booms of the crane. In this way, a lower pressure can be used in the multi-chamber cylinders.

By means of the crane according to the invention, a more durable and more freely operable crane structure than cranes of the prior art is achieved, which can be implemented more simply, with a lighter weight and a lower centre of gravity. In addition, the construction according to the invention permits very good controllability of the crane, as for example, when lifting a load closer to the base of the crane, the load causes a pressure in the lifting cylinder, which has a direct advantageous effect on the pressure cylinder formed by the multi-chamber cylinder. Because at the same time the load in the crane tends to move the pressure cylinder against the pressure caused by the lifting cylinder, the carrying of the load towards the base of the crane takes place controllably, and not by swinging under the effect of gravity.

BRIEF DESCRIPTION OF THE DRAWINGS

In the following, the invention is described in detail with reference to the accompanying drawings depicting some embodiments of the invention, in which.

In the figures, the reference numbers refer to the following:

| | |
|---|---|
| 10 | crane |
| 12 | base |
| 14 | main boom |
| 16 | articulated boom |
| 18 | first end of main boom |
| 20 | second end of main boom |
| 22 | synchronization arm |
| 23 | end of articulated boom |
| 24 | lifting cylinder |
| 26 | multi-chamber cylinder |
| 27 | lower pivot of the pulling rod mechanism |
| 28 | auxiliary arm |
| 29 | lower pivot of the lifting cylinder |
| 30 | actuator cylinder |
| 32 | first cylinder chamber |
| 33 | upper pivot of the lifting cylinder |
| 34 | second cylinder chamber |
| 36 | third cylinder chamber |
| 37 | upper pivot of the articulation cylinder |
| 38 | fourth cylinder chamber |
| 39 | cylinder piston rod |
| 40 | crooking pressure line |
| 41 | cylinder piston |
| 42 | crooking return line |
| 44 | main directional-control valve |
| 45 | cross-flow position |
| 46 | auxiliary directional-control valve |

-continued

| | |
|---|---|
| 47 | plug position |
| 48 | lifting cylinder extension pressure line |
| 49 | direct-flow position |
| 50 | return line of the extension of the lifting cylinder |
| 52 | articulation cylinder |
| 54 | pressure cylinder |
| 55 | wide-angle pivot |
| 57 | hollow part of the piston rod |
| 59 | pivot between the auxiliary arm and articulated boom |
| 60 | cylinder component |
| 62 | feed line |
| 66 | arm mechanism |
| 67 | lower arm |
| 68 | pull rod |
| 71 | base of the lifting cylinder |
| 74 | partition |
| 76 | first piston |
| 78 | second piston |
| 80 | tank line |
| 84 | lug |
| 86 | lower boom part |
| 88 | upper boom part |
| 92 | pivot between main boom and base |
| 94 | pivot between lower end of lifting cylinder and and base |
| 96 | pivot between upper end of lifting cylinder and main boom |
| 102 | attachment means |
| 104 | articulation cylinder lower-end pivot |
| 106 | hydraulic accumulator |

DETAILED DESCRIPTION OF THE INVENTION

Figure 1A:
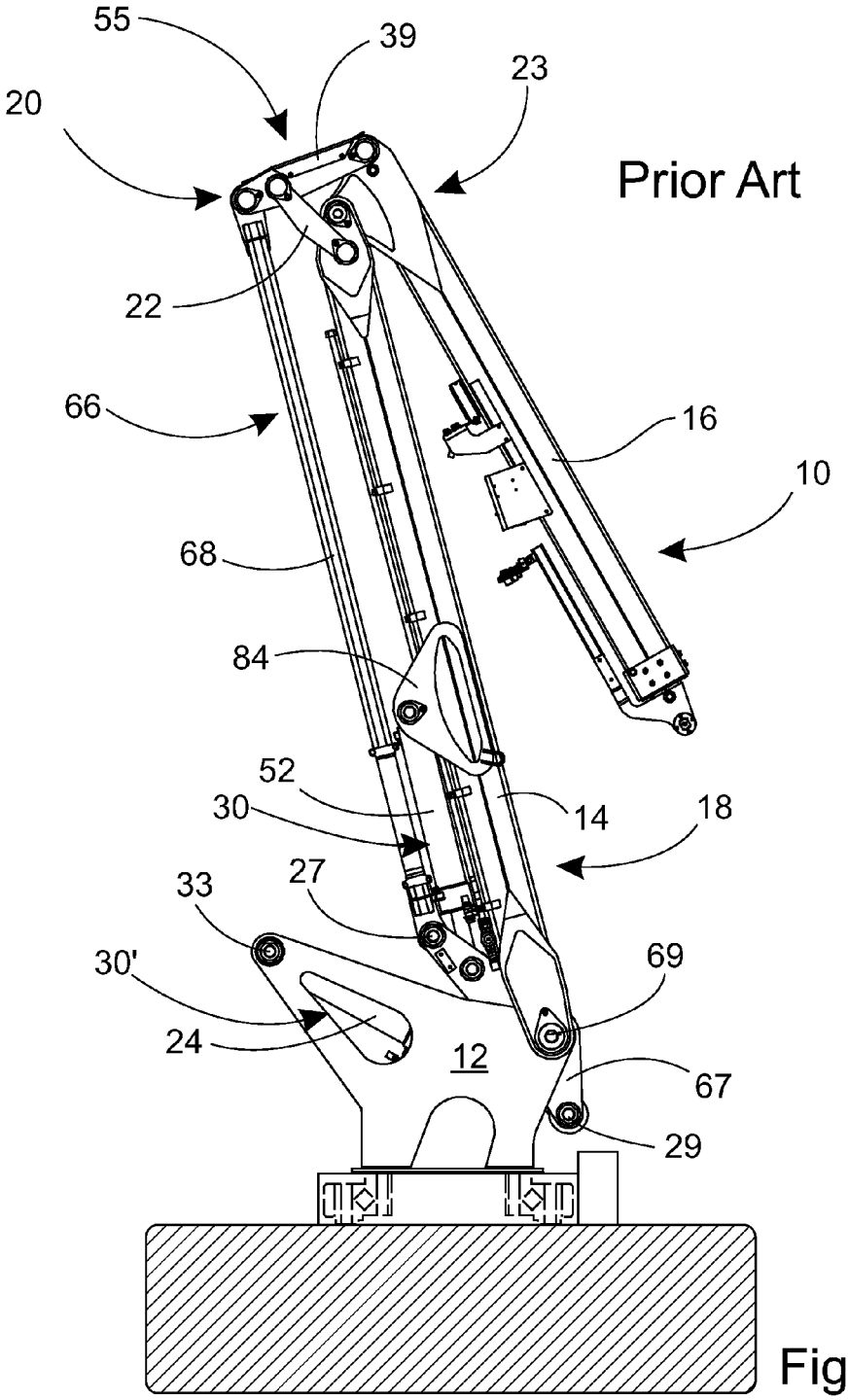
FIG. 1*a* shows a side view of a crane according to the prior art, when the booms of the crane are retracted.
Figure 1B:
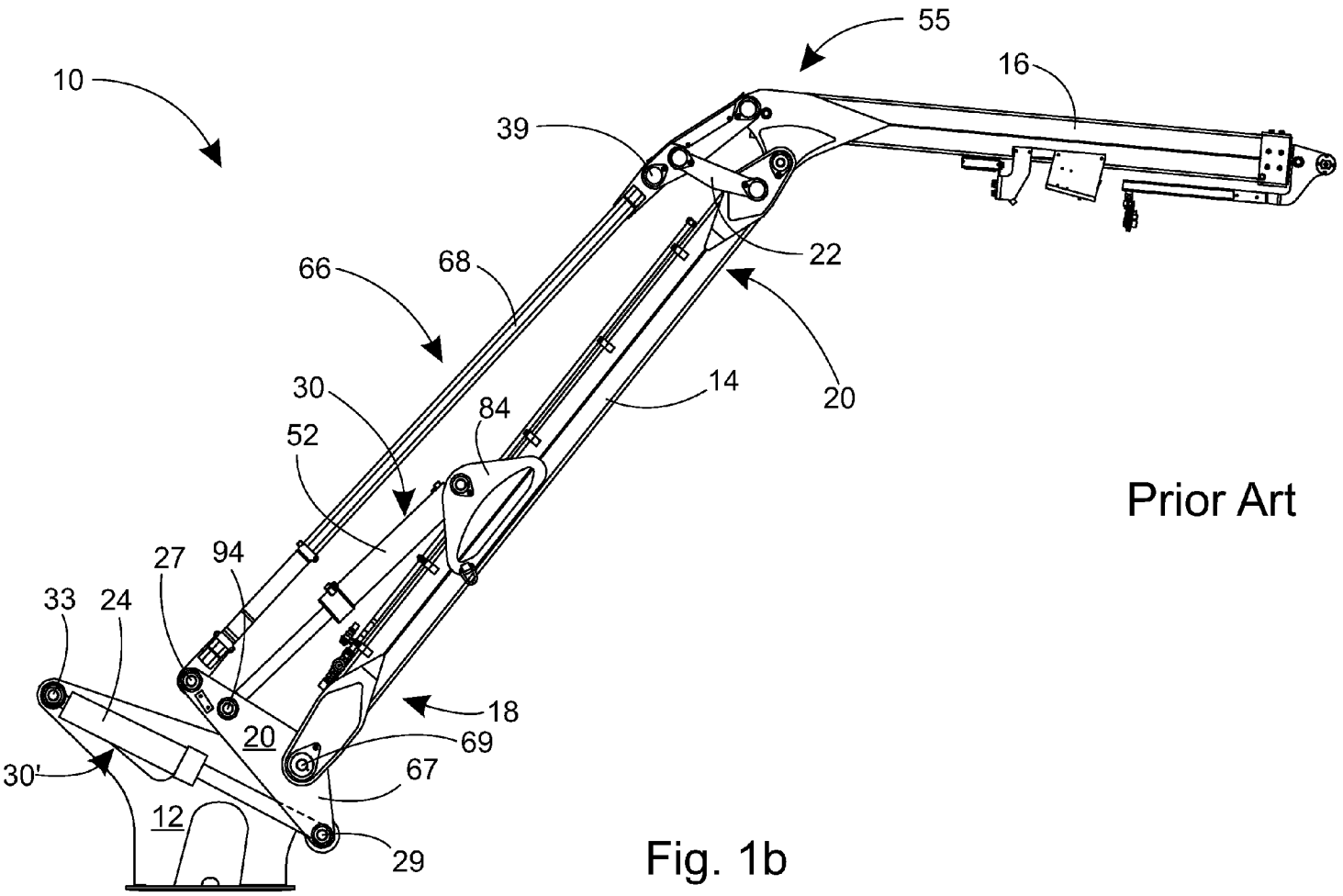
Prior Art Fig. 1b
FIG. 1*b* shows a side view of a crane according to the prior art, which the booms of the crane are extended.

FIGS. 1*a* and 1*b* show one crane 10 according to the prior art. The crane 10 of the figures is a path-of-motion crane, which includes a base 12, a main boom 14 pivoted to the base 12, and an articulated boom 16 pivoted to the main boom 14. The booms 14 and 16 of the crane 10 are operated with the aid of two actuator cylinders 30 and 30', of which one actuator cylinder 30 is a lifting cylinder 24 and the other 30' is an articulation cylinder 52.

According to FIGS. 1*a* and 1*b*, in the crane 10 according to the prior art the folding movement between the booms 14 and 16 is created using a mechanical arm mechanism 66. The arm mechanism 66 includes a lower arm 67 and a pull rod 68, with the aid of which the wide-angle pivot 55 and the synchronization arm 22 are operated. According to the figures, the arm mechanism 66 makes the construction of the crane 10 quite complicated and difficult in terms of design, as only few degrees of freedom remain relative to the locations of the different arms and pivots. In addition, the construction makes the crane expensive and heavy to implement.

Figure 1C:
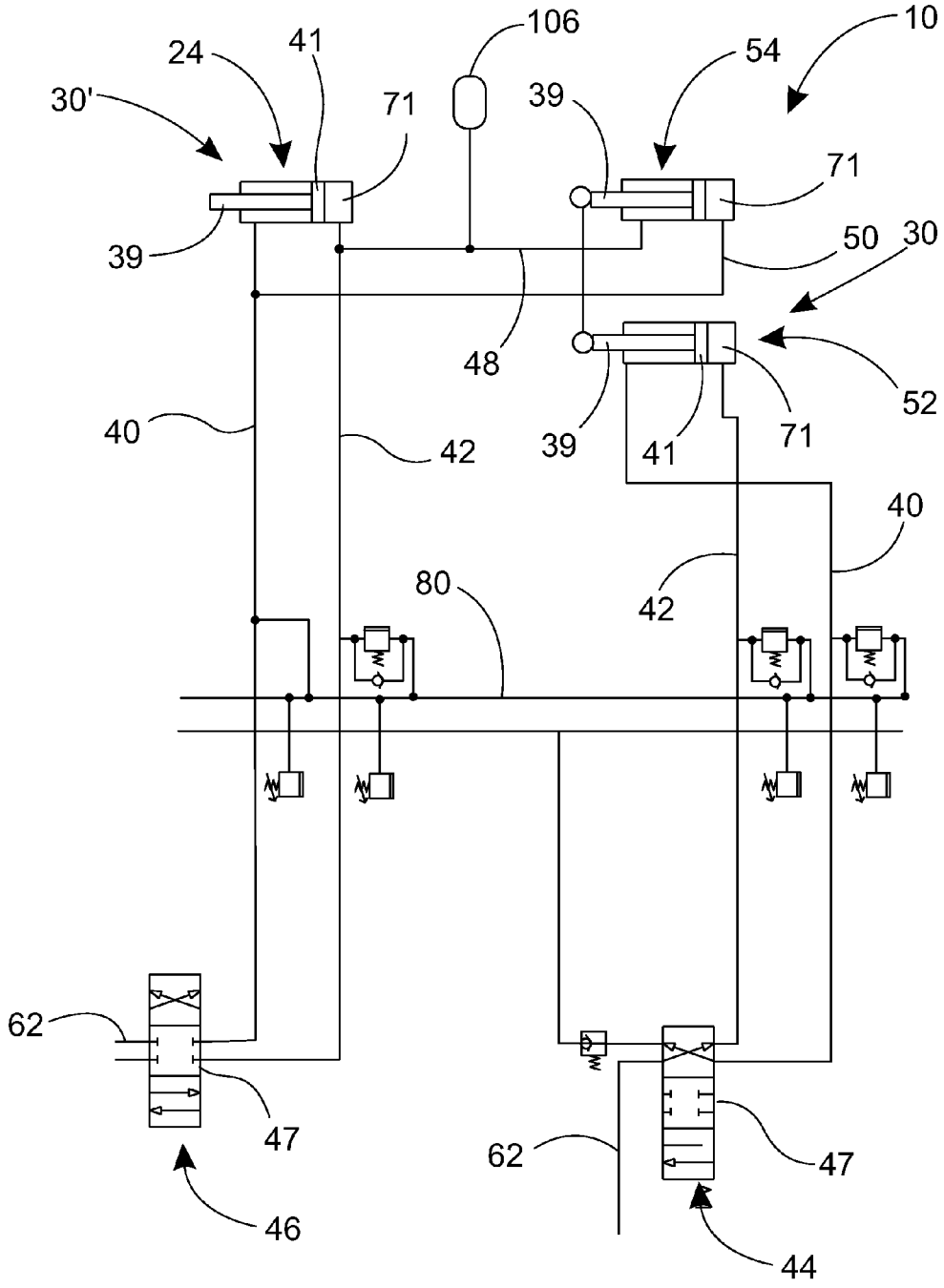
Prior Art Fig. 1c
FIG. 1*c* shows a schematic hydraulic diagram of a second crane according to the prior art.

FIG. 1*c* shows a schematic hydraulic diagram of a second crane according to the prior art. in this solution, the actuator cylinders 30 are arranged to operate in parallel, in such a way that the operating pressure fed to one actuator cylinder 30 is led with the aid of a pressure cylinder 54 to a second actuator cylinder 30'. The pressure cylinder 54 and the articulation cylinder 52are installed and connected in parallel, which is shown in FIG. 1*c*. According to the figure, the articulation cylinder 52 and the pressure cylinder 54 are connected in parallel, in such a way that the piston rods 39 of both cylinders are mechanically connected to each other. The feed pressure comes along the feed line 62 to the main directional-control valve 44, which is used to determine whether to extend or retract the crane's booms. If it is wished to extend the booms, the flow is directed by the main directional-control valve 44 to the flexion pressure line 42, which directs the pressurized hydraulic flow to the cylinder chamber of the side of the base 71 of the articulation cylinder 52 acting as the actuator cylinder. The pressure then moves the piston 41 and piston rod 39 outwards, when the same movement takes place correspondingly in the pressure cylinder 54, the piston rods 39 being permanently connected to each other. Pressure then arises in the pressure cylinder 54, on the side of the piston rod 39, which pressure is directed to the pressure line 48 for shortening the lifting cylinder 24 and through it to the cylinder chamber on the side of the base 71 of the lifting cylinder 24. From the side of the piston rod 39 of the lifting cylinder 24, the hydraulic-oil flow is directed to the return line 40, from where the flow finally goes to the tank line 80. Thus, the lifting cylinder 24 shortens and at the same time the boom 14 turns forwards around the pivot 69.

When it is wished to retract, i.e. crook, the booms of the crane, the direction of the main directional-control valve 44 is changed, so that the flow is directed to the piston 41 of the side of the piston rod 39 of the articulation cylinder 52, when the movements of the cylinders take place in reverse order. For the individual operation of the lifting cylinder 24, the crane can also include an auxiliary directional-control valve 46. The main directional-control valve 44 can be in a plugged position 47, when it is wished to use the auxiliary directional-control valve 46 when operating only the lifting cylinder. When operating the main directional-control valve 44, the auxiliary control-valve 46 can be in a plugged position 47, or in a flow position, depending whether it is wished to control the lifting cylinder independently of the articulation cylinder.

According to FIG. 1*c*, in a crane according to the prior art the articulation cylinder and pressure cylinder are located parallel to each other attached to the main boom. In other words, the longitudinal axis of the articulation cylinder is on one side of the longitudinal axis of the main boom and the longitudinal axis of the pressure cylinder is, for its part, on the other side of the longitudinal axis of the main boom. The cylinders are located symmetrically, but the forces they cause lead to asymmetrical stresses in the attachments and pivots of the main boom. The feed pressure is directed only to the actuator cylinder, so that it tends to cause torsion in the main boom. Similarly, if the lifting cylinder is operated with the aid of the auxiliary direction-control valve, the pressure cylinder directs an uneven distribution of forces to the main boom. A hydraulic accumulator 106, which attenuates swings, can be used between the cylinders. Its capacity is small, nor does it affect the path of motion.

Figure 2A:
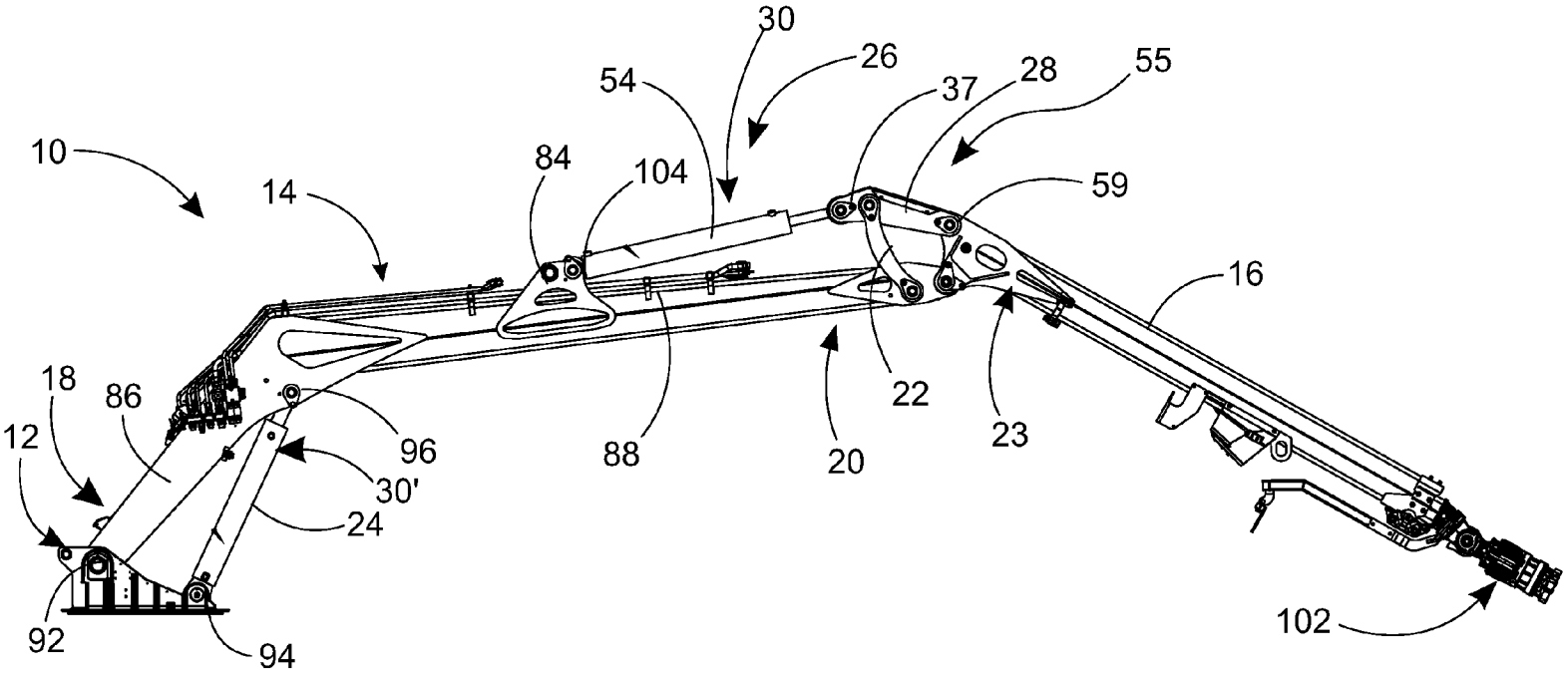
FIG. 2*a* shows a side view of a crane according to one embodiment of the invention, when the booms of the crane are extended.

FIG. 2*a* shows a first embodiment of the crane 10 according to the invention. The crane 10 includes a base 12 for attaching the crane 10, for example, to a harvester or similar work machine, and a main boom 14, comprising a first end 18 and a second end 20, with the aid of the first end 18 of which the main boom 14 is pivoted to the base 12. Further, the crane 10 includes an articulated boom 16 pivoted at one end 23 to the second end 20 of the main boom 14. In addition, the crane 10 includes at least two cylinders 30 and 30' for operating the main boom 14 and the articulated boom 16, as well as a pressure cylinder 54 (shown in FIG. 2*b*) arranged to follow one actuator cylinder 30 in order to produce pressure for the other actuator cylinder 30'. In the crane according to the invention, the pressure cylinder 54 is integrated coaxially with one actuator cylinder 30, to form a multi-chamber cylinder 26. In the preferred embodiments of FIGS. 2*a*-3*b*, the articulation cylinder 52 and the pressure cylinder 54 are combined to form a multi-chamber cylinder 26.

Figure 2B:
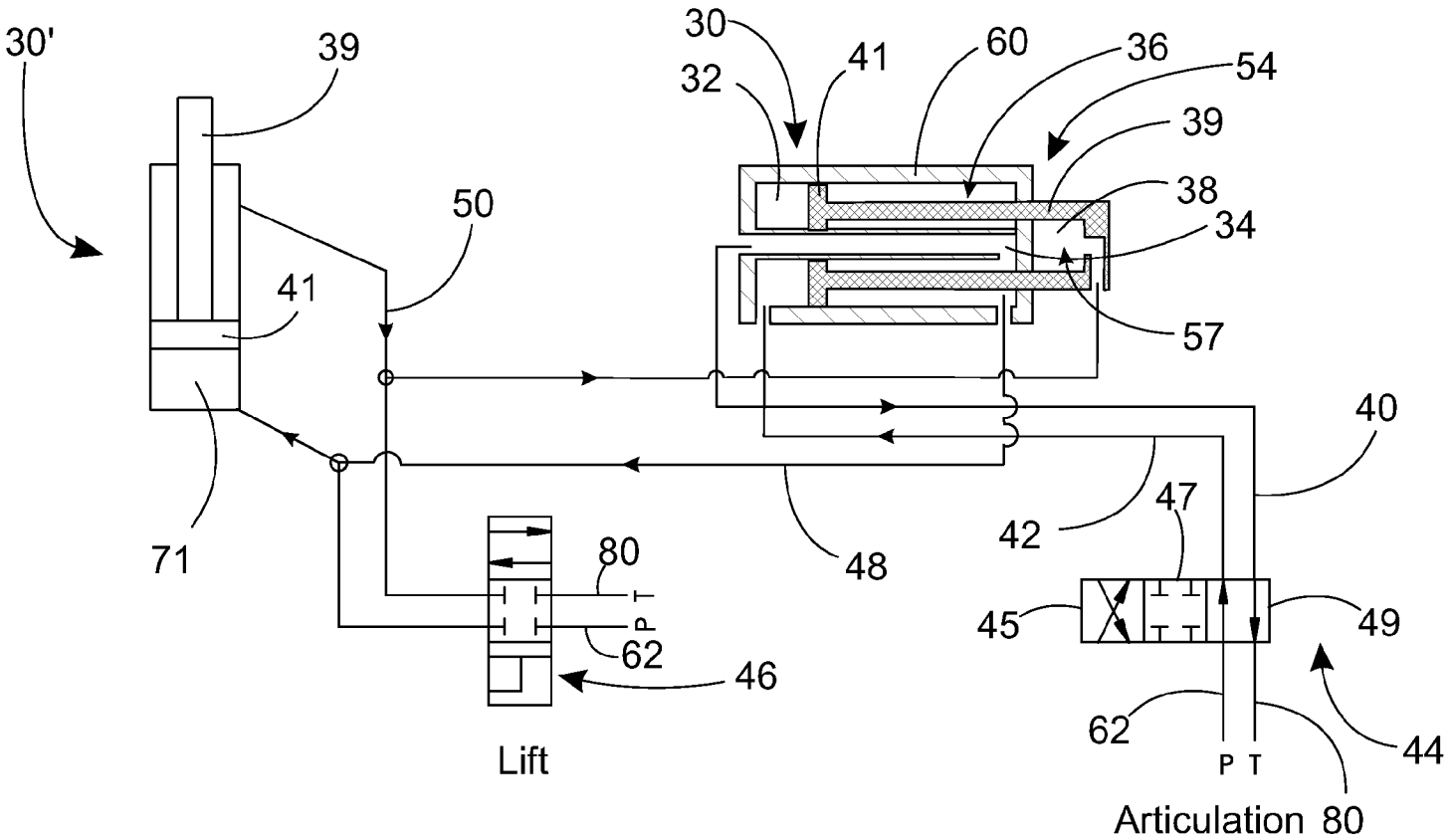
FIG. 2*b* shows a schematic hydraulic diagram of a crane according to one embodiment of the invention.

FIG. 2*b* shows a schematic hydraulic diagram according to a first embodiment of the crane of the invention. According Co the figure, the greatest difference in the hydraulic diagram relative to the prior art is the combining of the pressure cylinder 54 and the actuator cylinder 30 to form a single multi-chamber cylinder 26. In this embodiment, the multi-chamber cylinder 26 consists of two cylinders arranged at least partly one inside the other. The actuator cylinder 30 is formed of a first cylinder chamber 32 on the bottom of the cylinder part 60 of the multi-chamber cylinder 26 and a second cylinder chamber 34 on the piston rod 39 side, in the hollow part 57 of the piston rod 39 formed on the inside of the cylinder part 60 of the multi-chamber cylinder 26. Of these, the first cylinder chamber 32 acts as the pressure side of the actuator cylinder when crooking the booms of the crane, while the second cylinder chamber 34 acts as the escape side.

The second cylinder of the multi-chamber cylinder 26, i.e. the pressure cylinder 54, consists of a third cylinder chamber 36 inside the cylinder part 60 on the piston-rod 39 side and external to the piston rod 39, and a fourth cylinder chamber 38 on the piston-rod side, external to the cylinder part 60 and forming in the hollow piston rod 39. Of these, the third cylinder chamber 36 is the pressure side and the fourth cylinder chamber 38 in turn the escape side, when retracting the crane's booms.

According to FIG. 2*b*, the hydraulics of the crane according to the invention preferably include two directional-control valves 44 and 46, of which that on the right-hand side in the figure is the main directional-control vale 44 and the that on the left-hand side the auxiliary directional-control valve 46. In the figure the main directional-control valve 44 is in the direct-flow position 49, when the crane's booms approach each other, i.e. the booms are retracted. The flow of pressurized hydraulic oil is initially directed from the pump along the feed line 62 to the main directional-control valve 44. From there the flow is directed in the situation according to FIG. 2*b* to the pressure line 42 of the retraction of the booms, i.e. crooking, which line in turn leads the flow to the first cylinder chamber 32 of the multi-chamber cylinder 26. In the first cylinder chamber 32, the pressure begins to push the piston 41 of the multi-chamber cylinder 26, and with its aid the piston rod 39. The oil in the second cylinder chamber 34 flows out of the second cylinder chamber 34 to the crooking return line 40 and through it on to the main directional-control valve 44 and the tank line 80. With the aid of this movement of the actuator cylinder the length of the articulation cylinder increases and with the aid of the wide-angle pivot the articulated boom crooks relative to the main boom.

At the same time as the pressure in the first cylinder chamber 32 moves the piston 41 of the multi-chamber cylinder 26, the hydraulic oil in the third cylinder chamber 36 is pressed out of the third cylinder chamber 36 to the pressure line 48 of the extension of the lifting cylinder 24, from where the flow is directed to the cylinder chamber of the side of the bottom 71 of the lifting cylinder 24. The piston 41 of the lifting cylinder 24 then moves, pushing the piston rod 39 outwards, when the hydraulic oil of the lifting cylinder 24 flows from the side of the piston rod 39 to the return line 50 of the extension of the lifting cylinder 24. From the return line 50 the flow travels to the fourth cylinder chamber 38 of the multi-chamber cylinder 26.

If it is wished to extend the crane's booms, the main directional-control valve is turned to the cross-flow position 45, when the piston of the multi-chamber cylinder moves in the opposite direction, simultaneously also moving the lifting cylinder with the aid of a hydraulic direction connection. If it is wished to adjust the vertical height of the articulated boom of the crane, the lifting cylinder can be used separately without turning the articulated boom relative to the main boom.

For such situations, the crane preferably also includes an auxiliary directional-control valve 46, by means of which pressure can be directed to the lifting cylinder 24, without moving the multi-chamber cylinder 26. Because the lifting cylinder 24 and the multi-chamber cylinder 26 are connected hydraulically in series, the movement of the lifting cylinder 24 tends to move the multi-chamber cylinder 26. For this purpose the main directional-control valve 44 also includes a plug position 47, by means of which the flows of the first and second cylinder chambers 32 and 34 can be prevented. The operation of the pressure cylinder is then also prevented. If necessary, the lifting cylinder can always also be run simultaneously with the articulation cylinder, if it is wished to raise or lower the articulated boom.

In this embodiment, the second cylinder chamber 34 and third cylinder chamber 36 of the multi-chamber cylinder 26 are mutually replaceable in terms of their functions. This means that the second cylinder chamber 34 can also be used as part of the pressure cylinder, in which case the third cylinder chamber 36 is used as part of the actuator cylinder. The first cylinder chamber 32 and fourth cylinder chamber 38 can also be exchanged mutually, if the dimensioning can be made compatible with the geometry of the crane.

Figure 3A:
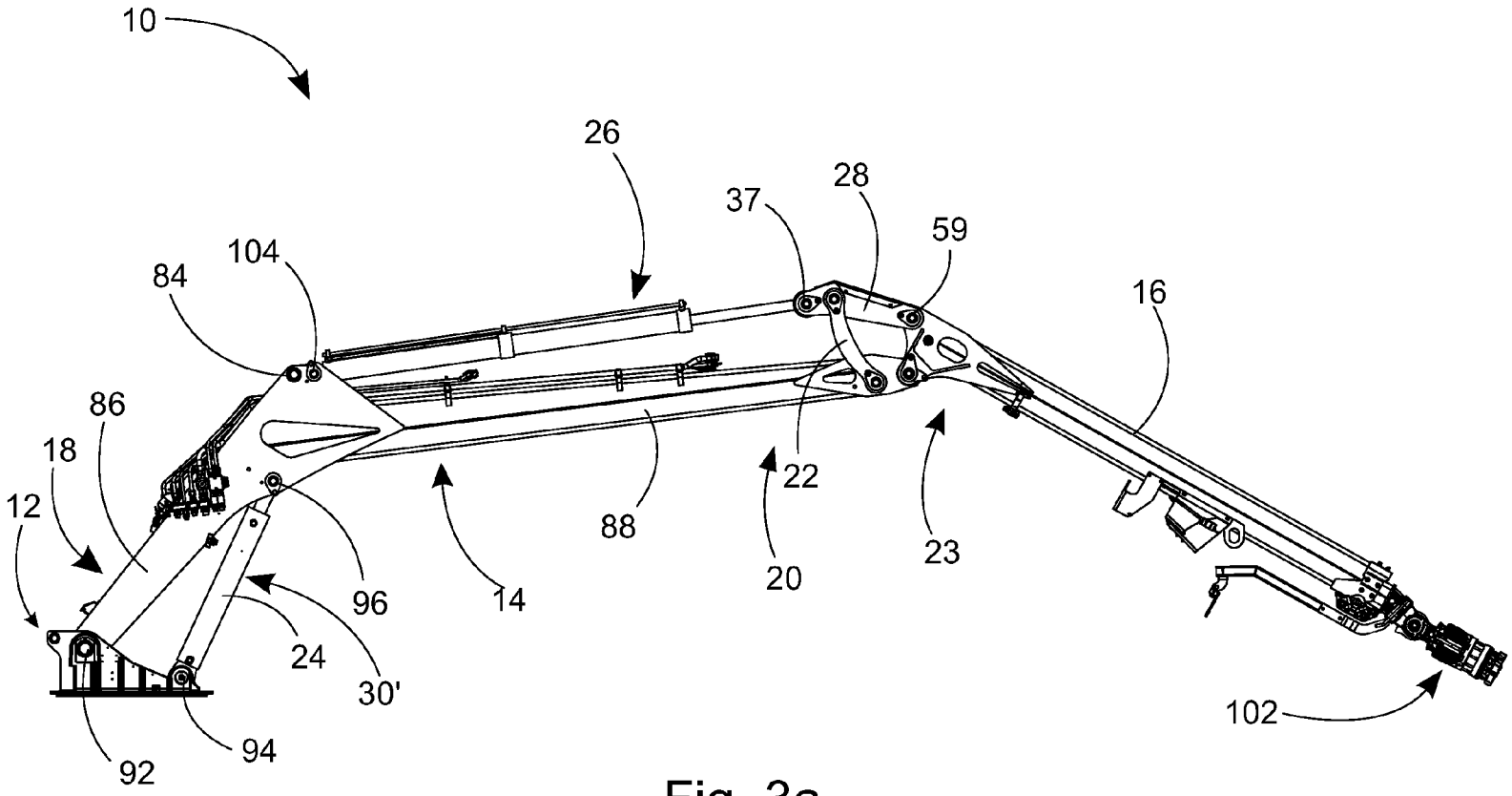
FIG. 3*a* shows a side view of a crane according to a second embodiment of the invention, when the booms of the crane are extended.

FIG. 3*a* shows a crane according to a second embodiment of the invention. The difference between the embodiments of FIG. 2*a* and FIG. 3*a* is that, in the embodiment of FIG. 3*a*, the multi-chamber cylinder 26 is implemented by situating the actuator cylinder and the pressure cylinder essentially coaxially sequentially, whereas in the embodiment of FIG. 2*a* these cylinders are at least partly one of top of the other in the radial direction of the multi-chamber cylinder. In this connection, the word essentially refers to the fact that the cylinders forming the multi-chamber cylinder need not necessarily be completely concentric. In addition, there is also a difference in the construction of the multi-chamber cylinder 26, in the attachment of the multi-chamber cylinder 26 to the main boom 14. According to FIG. 3*a*, the main boom 14 can be slightly curved in shape, i.e. it consists of two boom parts 86 and 88 attached to each other at an angle of more than 90. In the embodiment of FIG. 2*a*, the attachment of the multi-chamber cylinder 26 acting as the articulation cylinder 52 takes place to a lug 84, which is located about halfway along the upper boom part 88. In the embodiment of FIG. 3*a*, the multi-chamber cylinder is longer, so that the lug 84 is moved farther from the wide-angle pivot 55 between the main boom 14 and the articulated boom 16. In this embodiment, the lug 84 can be roughly at the joint of the boom parts 86 and 88 of the main boom 14.

Figure 3B:
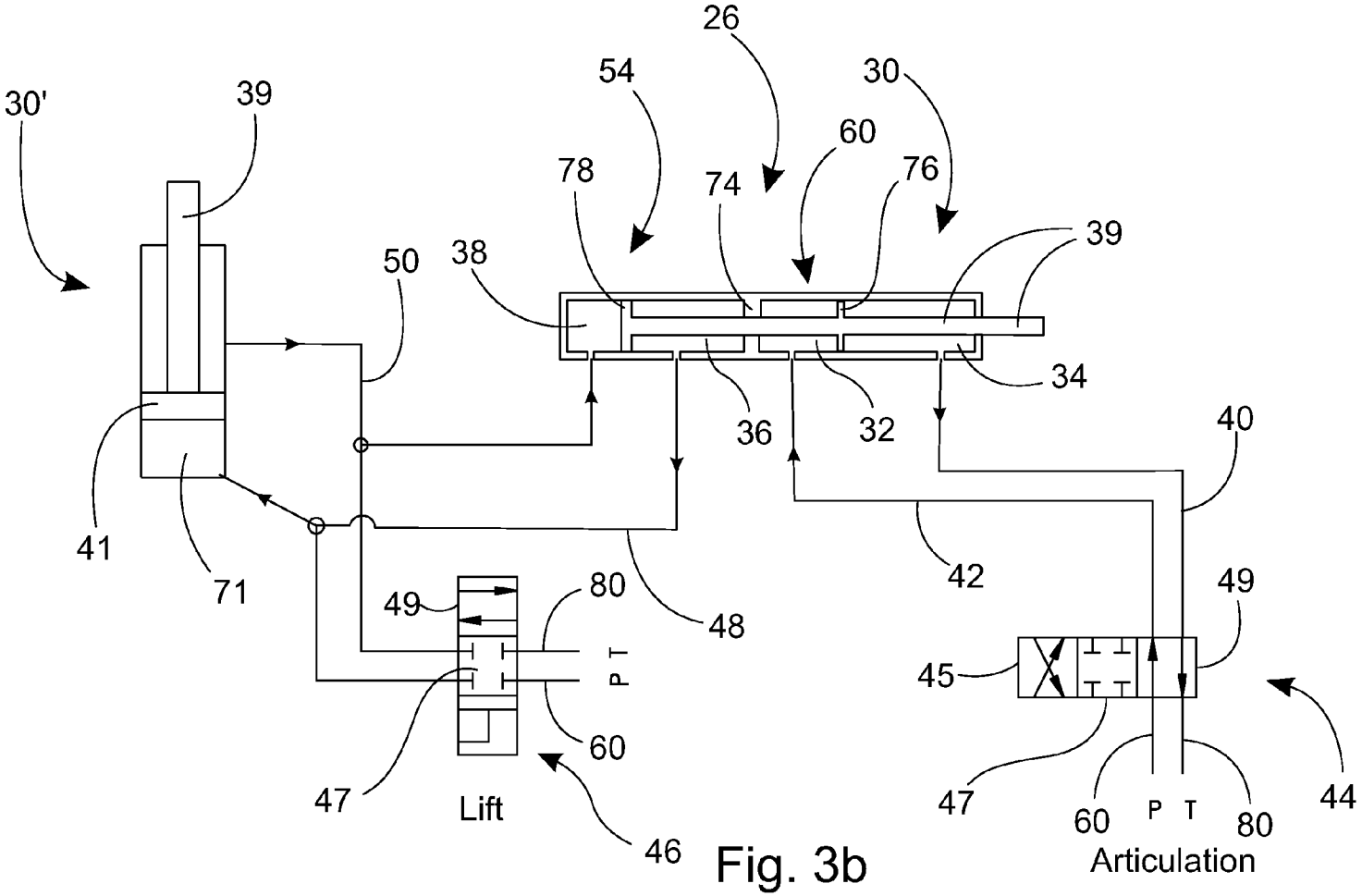
FIG. 3*b* shows a schematic hydraulic diagram of a crane according to a second embodiment of the invention.

According to FIG. 3*b*, the crane according to the second embodiment of the invention can be, in its hydraulics, very similar to the embodiment according to FIG. 2*b*. Only the construction of the multi-chamber cylinder differs from the embodiment of FIG. 2*b*. In the embodiment of FIG. 3*a*, the multi-chamber cylinder 26 consists of an actuator cylinder 30 and a pressure cylinder 54. Here, the cylinders are set concentrically, i.e. coaxially sequentially, and they use the same the piston rod 39. The partition 74 between the cylinders is arranged to be penetrated by the piston rod 39. Two pistons are formed on the piston rod 39, a first piston 76 in the actuator cylinder and a second piston 78 in the pressure cylinder. The multi-chamber cylinder preferably includes four cylinder chambers, of which the first cylinder chamber 32 and the second cylinder chamber 34 form the actuator cylinder 52 and the third cylinder chamber 36 and fourth cylinder chamber 38 form the pressure cylinder 54.

According to FIG. 3*b*, if it is wished to crook the crane's booms, pressure is directed through the main directional-control valve 44 to the first cylinder chamber 32. The operation of all the cylinder chambers corresponds in principle to the operation of the cylinder chambers of the multi-chamber cylinder according to FIG. 2*b*. The diameters of the cylinder sleeves and piston rods in the multi-chamber cylinder of the sequential cylinders can be optimized better in terms of hydraulics than in the multi-chamber cylinder according to FIG. 2*b*. Further, the construction of the multi-chamber cylinder according to FIG. 3*b* is simpler to implement and thus cheaper to manufacture. The movement of the attachment point between the multi-chamber cylinder and the main boom close to the joint of the boom parts of the main boom reduces the bending strain in the horizontal boom part of the main boom. The multi-chamber cylinder of the sequential actuator cylinders can be implemented without the danger of buckling, because the stroke remains mainly as before and the length is about one metre. The multi-chamber cylinder of the nesting cylinders is, for its part, about 50-mm thicker in diameter than the multi-chamber cylinder of the sequential cylinders.

According to FIGS. 2*a* and 3*a*, there can be attachment means 102, for example for a harvester working head or similar at the second end of the articulated boom 16. The main boom 14 can be attached according to FIGS. 2*a* and 3*a* to the edge of the base 12. Preferably the attachment point of the main boom 14 with the aid of the pivot 92 to the base 12 is as far as possible from the attachment point of the lifting cylinder 24 to the base 12 with the aid of the pivot 92. Thus the force arm produced by the lifting cylinder lifting the main boom is maximized. Preferably the lifting cylinder 24 is attached to the main boom 14 with the aid of the pivot point 96 to the upper end of the lower boom part 86, close to the joint between the boom parts 86 and 88. Between the main boom 14 and the articulated boom 16 there can be a wide-angle pivot 55, which is of a type known from the prior art, consisting of an auxiliary arm 28 between the pivot 37 at the upper end of the articulation cylinder 52 and the pivot 59 of the articulated boom 16 and a synchronization arm 22 pivoted to it and to the main boom 14. With the aid of the wide-angle pivot, the movement extending the length of the articulation cylinder is converted to a movement crooking the booms and the movement shortening the length in turn to a movement extending the booms.

The combining of the actuator cylinder and the pressure cylinder to form a coaxial multi-chamber cylinder solves the second problem of the asymmetrical forces of the solutions according to the prior art according to FIG. 1*c*, because in the coaxial multi-chamber cylinder the forces act essentially parallel to the same axis and at the same time concentrically. With the aid of the multi-chamber cylinder, the construction of the crane can be lightened compared to a crane according to the prior art of FIGS. 1*a* and 1*b*. Compared to the crane of the prior art according to FIG. 1*a*, the complicated arm mechanism 66 becomes mainly unnecessary. In the crane according to the invention, only the synchronization arm 22 and the wide-angle pivot 55 between the main boom 12 and the articulated boom 16 of the arm mechanism 66 of the crane according to the prior art is used. The lower arm and the pull rod can be removed and the base 12 can be made considerably simpler. Through these changes, the crane according to the invention is considerably lighter than a crane according to the prior art and is cheaper to manufacture. Further, the centre of gravity of the crane is moved closer to the base, which improves the stability of the work machine and the crane's net lifting moment increases.

The shaping of the main boom in the crane according to the invention can be implemented more freely than the solution of the prior art of FIGS. 1*a* and 1*b*. In the solutions according to the prior art, the straight shape of the lever rod of the arm mechanism has restricted to shape of the main boom to only a straight piece. Giving up the use of the arm mechanism permits wider paths of motion for the crane according to the invention, without the restrictions in the movement of the booms caused by the arm mechanism. Thus, the end on the side of the attachment means of the articulated boom of the crane according to the invention can be lifted considerably higher, nearly straight above the base.

In the crane according to the invention, it is also possible to use so-called regenerative operation, in which pressure is directed to both sides of the piston of the actuator cylinder of the multi-chamber cylinder. The movement of the actuator cylinder is then considerably quicker, as the hydraulic pump does not require so much volume flow. For this function, there can be an additional position in the main directional-control valve, which guides the pressure flows to both the crooking pressure line and the return line. Alternatively, in the valve according to the figure there can be a different spindle, which directs the volume flow coming from the arm side back to the side of the bottom of the cylinder and not to the tank. This operates only in the extension movement of the cylinder. The multi-chamber cylinder with sequential cylinders can also be used regeneratively, if the locations of the actuator cylinder and pressure cylinder are mutually changed. Alternatively, regenerative operation can be implemented, if the functions of the cylinder chambers of the multi-chamber cylinder are in such a way that the actuator cylinder and the pump cylinder are in the opposite order to that in FIG. 3*b*. By means of the order of the cylinder chambers of the multi-chamber cylinder of the embodiment shown in FIG. 3*b*, the piston rod on the side of the pressure cylinder can be implemented in a thinner form, when it will be easier to optimize the volume of the cylinder chamber. On the actuator cylinder side the piston rod is thicker, so that there will be no danger of buckling.

According to one embodiment, the volume of the second cylinder chamber connected to the return line of the extension of the actuator cylinder corresponds to the cylinder chamber of the side of the bottom of the lifting cylinder, so that the lifting cylinder will completely follow the movement of the multi-chamber cylinder. The volumes of the cylinder chambers of the pressure cylinder and the lifting cylinder need not necessarily be the same, as long as the change in volume over a specific movement of the pressure cylinder creates the desired movement in the lifting cylinder.

Though in the embodiments shown in the figures the articulation cylinder and pressure cylinder are combined to form a multi-chamber cylinder, the lifting cylinder and pressure cylinder can also be combined to form a multi-chamber cylinder. The articulation cylinder will then be a conventional cylinder. Such an alternative is, however, poorer in terms of the operation of the crane, as the main boom naturally cannot then be lifted without folding the articulated boom without separate components, by means of which the connection between the articulation cylinder and lifting cylinder can be cut.

FIG. 4 a shows a hydraulic diagram of a third embodiment of the crane according to the invention. In this embodiment, two pressure cylinders 54 are used, both of which pressure cylinders 54 are integrated in connection with the actuator cylinders 30 and 30' to form multi-chamber cylinders 26. In other words, both actuator cylinders 30 and 30' are multi-chamber cylinders 26. Preferably, there is also a hydraulic accumulator 106 in connection with the actuator cylinder 30 operating the main boom, in which a charging pressure can be maintained, which can be used to carry the booms of the crane. This pressure can be exploited when lifting the main boom at the same time as the articulated boom is retracted, i.e. when the end of the articulated boom is run as close as possible to the base of the crane. In this situation, when using an embodiment according to FIG. 2*b* or 3*b*, the load at the end of the articulated boom raises the pressure in the lifting cylinder to a considerable extent. At the same time, it is necessary to also raise the pressure formed by the hydraulic pump to the articulation cylinder, which becomes too great, the surface area at the bottom of the piston of the articulation cylinder being greater than the surface area of the piston on the side of the piston rod. Thus, the excess pressure must be released through the safety valve on the control block, at the same time wasting energy.

Figure 4A:
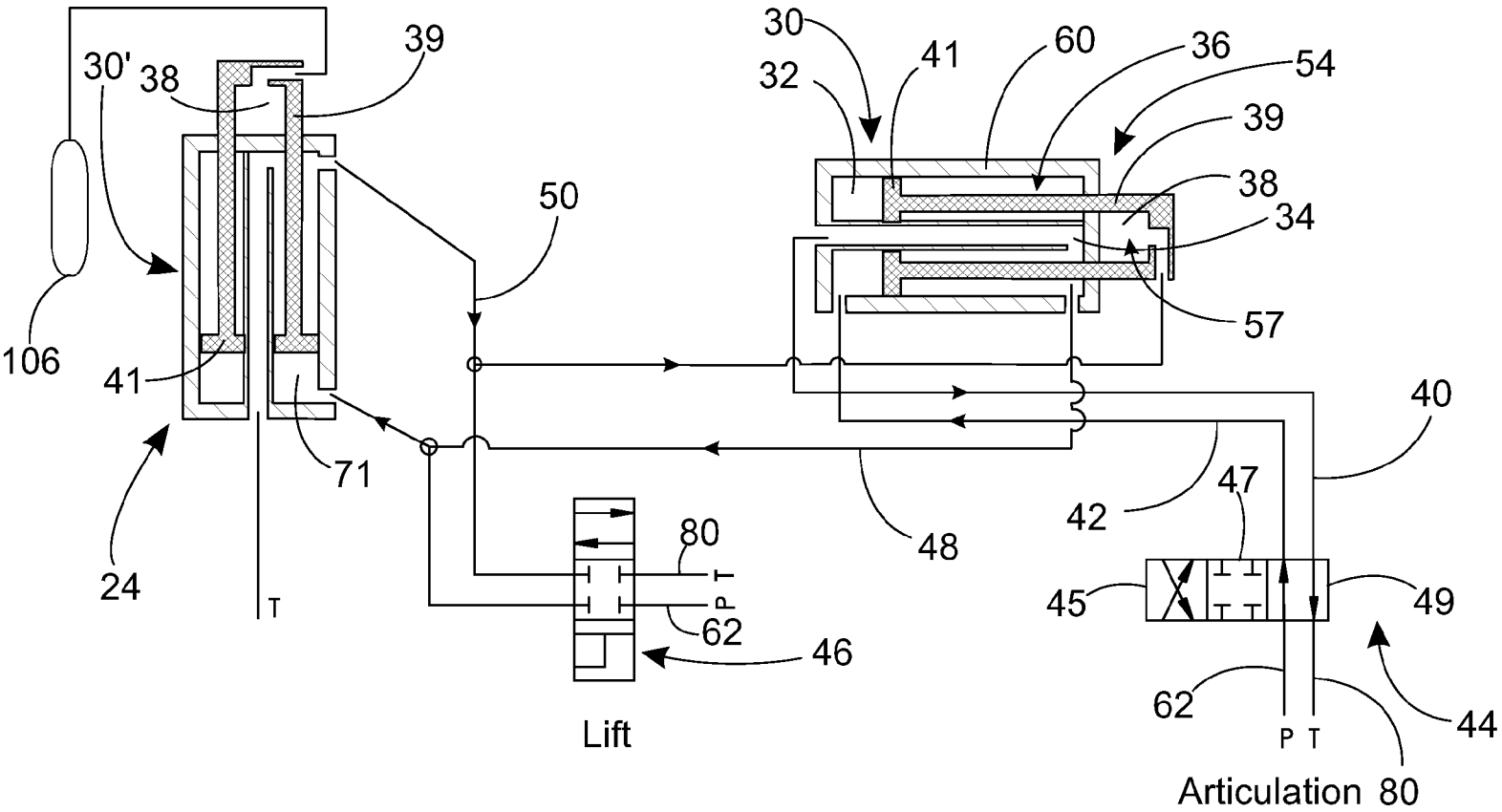
FIG. 4*a* shows a schematic hydraulic diagram of a crane according to a third embodiment of the invention.

In the crane according to FIG. 4*a*, the pressure in the hydraulic accumulator compensates for the mass of the load in the crane, so that a lower pressure can be used in both multi-chamber cylinders. The pressure level created by the hydraulic pump can then be at a lower level the whole time, and the pressure created need not be released to waste through the safety valve. In addition, the lifting and pressure cylinders can be slightly smaller in size than when using a conventional actuator cylinder as the lifting cylinder. The amount of oil to be moved in the path-of-motion movement is also smaller.

Figure 4B:
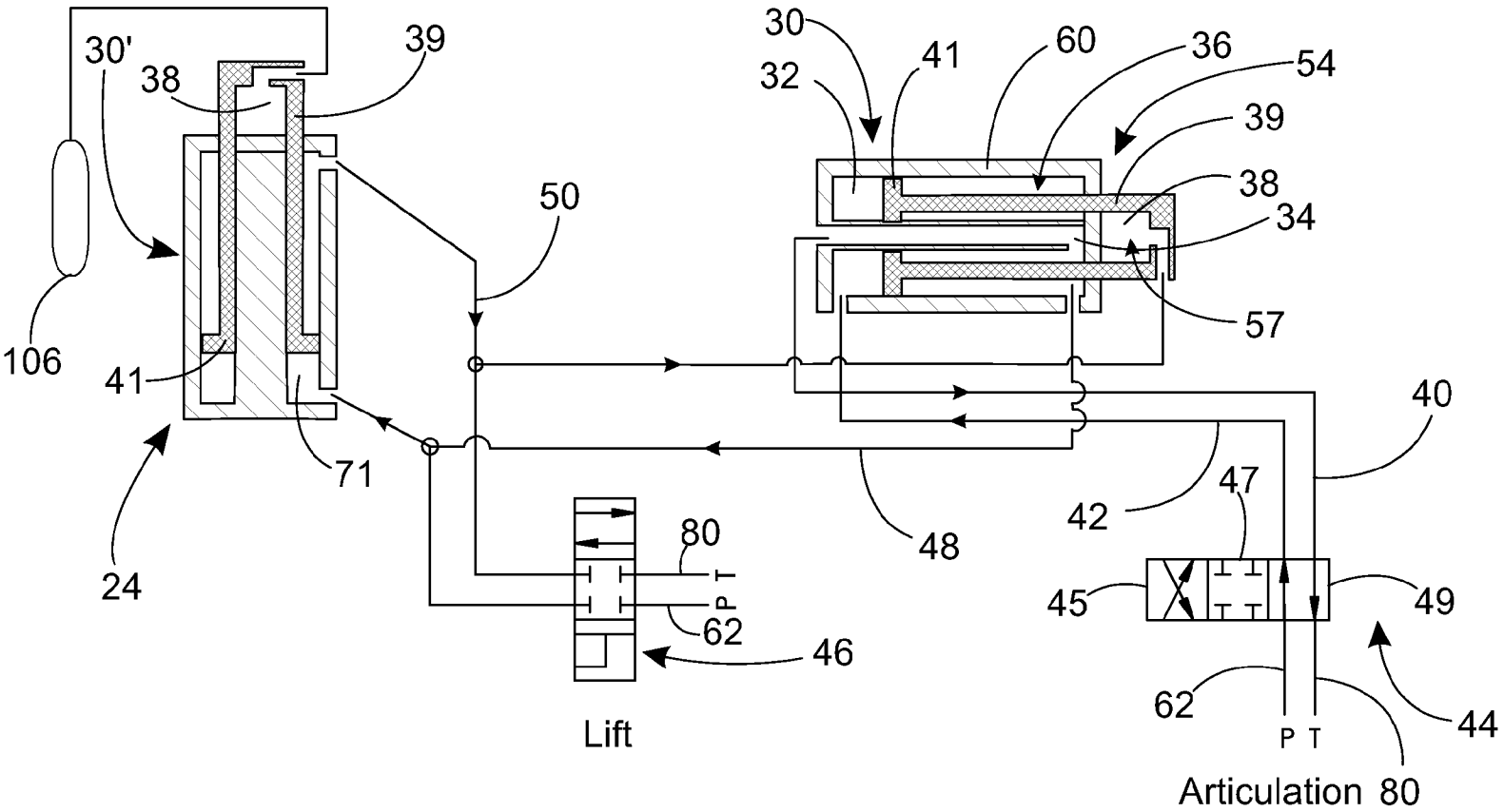
FIG. 4*b* shows a schematic hydraulic diagram of a crane according to a fourth embodiment of the invention.

FIG. 4*b* shows a hydraulic diagram of a fourth embodiment of the crane according to the invention. In this embodiment, such a multi-chamber cylinder is used, in which there are only three chambers, instead of the four of the other embodiments. Such a construction can be used in place of the multi-chamber cylinder replacing the lifting cylinder of FIG. 4*a*.

The crane according to the invention can be used, for example, not only in harvesters, or in other corresponding applications relating to tree felling and processing, but also in connection with various kinds of excavator or similar. The materials to be used in the crane can the materials generally used in cranes, such as welded structural steel, cast materials, or similar.

The invention claimed is:

1. Crane, comprising a base for attaching the crane, a main boom pivoted to the base, an articulated boom pivoted to the main boom, a first actuator cylinder comprising a first cylinder chamber and a second cylinder chamber, a second actuator cylinder comprising a cylinder part, a piston rod, a third cylinder chamber, and a fourth cylinder chamber, the second actuator cylinder integrated coaxially with a pressure cylinder to form a coaxial multi-chamber cylinder, the pressure cylinder comprising a fifth cylinder chamber coaxially arranged with the two cylinder chambers of the second actuator cylinder, the piston rod being common for both the second actuator cylinder and the pressure cylinder and the pressure cylinder being arranged to follow the second actuator cylinder and to produce hydraulic pressure for the first actuator cylinder, a first pressure line connected to the third cylinder chamber of the second actuator cylinder, a second pressure line connected between the fifth cylinder chamber of the pressure cylinder and the first cylinder chamber of first actuator cylinder, and a return line connected to the second cylinder chamber of first actuator cylinder, where one of the first actuator cylinder and the second actuator cylinder is arranged to move the main boom relative to the base and the other is arranged to move the articulated boom relative to the main boom.

2. Crane according to claim 1, wherein in the multi-chamber cylinder the second actuator cylinder and the pressure cylinder are at least partly on top of, or inside each other, in the radial direction of the multi-chamber cylinder.

3. Crane according to claim 1, wherein the multi-chamber cylinder comprising a cylinder part and a hollow piston rod, which hollow piston rod is hollow until exterior of the cylinder part of the multi-chamber cylinder.

4. Crane according to claim 1, wherein the multi-chamber cylinder comprising four cylinder chambers, of which the third cylinder chamber of the side of the bottom belonging to the multi-chamber cylinder and the fourth cylinder chamber inside the piston rod on the side of the piston rod belonging to the multi-chamber cylinder are arranged to form the second actuator cylinder and the fifth cylinder chamber external to the piston rod on the side of the piston rod of the multi-chamber cylinder and the sixth cylinder chamber external to the cylinder part inside the piston rod are arranged to form the pressure cylinder.

5. Crane according to claim 1, wherein the multi-chamber cylinder has smaller degree of movement than the first actuator cylinder not belonging to the multi-chamber cylinder.

6. Crane according to claim 1, wherein the actuator cylinder and pressure cylinder in the multi-chamber cylinder are essentially coaxially sequential.

7. Crane according to claim 6, wherein the multi-chamber cylinder comprising a cylinder component, a partition for dividing the cylinder component into two parts, and a piston rod penetrating the partition.

8. Crane according to claim 6, wherein in the multi-chamber cylinder the actuator cylinder is on the side of the piston rod.

9. Crane according to claim 1, wherein the actuator cylinder operating the main boom is pivoted between the base and the main boom.

10. Crane according to claim 1, wherein the crane comprising two pressure cylinders and both actuator cylinders are multi-chamber cylinders.

11. Crane according to claim 10, wherein the crane comprising a hydraulic accumulator arranged in connection with the multi-chamber cylinder operating the main boom, for producing additional pressure for the multi-chamber cylinder.

12. Crane according to claim 1, wherein the pressure cylinder is functionally between the actuator cylinders.

13. Crane, comprising a base for attaching the crane, a main boom pivoted to the base, an articulated boom pivoted to the main boom, a first actuator cylinder comprising a first cylinder chamber and a second cylinder chamber, a second actuator comprising a cylinder part, a piston rod, a third cylinder chamber, and a fourth cylinder chamber, the second actuator cylinder integrated sequentially with a pressure cylinder to form a coaxial multi-chamber cylinder, the pressure cylinder comprising a fifth cylinder chamber sequentially arranged with the third and fourth cylinder chambers of the second actuator cylinder, the piston rod being common for both the second actuator cylinder and the pressure cylinder and the pressure cylinder being arranged to follow the second actuator cylinder and produce hydraulic pressure for the first actuator cylinder, a first pressure line connected to the third cylinder chamber of the second actuator cylinder, a second pressure line connected between the fifth cylinder chamber of the pressure cylinder and the first cylinder chamber of the first actuator cylinder, and a return line connected to the second cylinder chamber of the first actuator cylinder, where one of the first actuator cylinder and the second actuator cylinder is arranged to move the main boom relative to the base and the other is arranged to move the articulated boom relative to the main boom.

14. Crane according to claim 13, wherein the multi-chamber cylinder comprising a cylinder component, a partition for dividing the cylinder component into two parts, and a piston rod penetrating the partition.

15. Crane according to claim 14, wherein in the multi-chamber cylinder the actuator cylinder is on the side of the piston rod.

16. Crane according to claim 15, wherein the first actuator cylinder operating the main boom is pivoted between the base and the main boom.

17. Crane according to claim 13, wherein the crane comprising two pressure cylinders and both said actuator cylinders are multi-chamber cylinders.

18. Crane according to claim 17, wherein the crane comprising a hydraulic accumulator arranged in connection with the multi-chamber cylinder operating the main boom, for producing additional pressure for the multi-chamber cylinder.

19. Crane according to claim 13, wherein the pressure cylinder is functionally between the actuator cylinders.

20. Crane according to claim 1, where the pressure cylinder comprises a sixth cylinder chamber connected to the return line.

21. Crane according to claim 13, where the pressure cylinder comprises a sixth cylinder chamber connected to the return line.

* * * * *